US010440458B2

(12) United States Patent
Basseas et al.

(10) Patent No.: US 10,440,458 B2
(45) Date of Patent: Oct. 8, 2019

(54) COMFORT AND HIGH RETENTION VIBRATION AND SOUND DAMPING EAR TIPS

(71) Applicant: CONVERSION SOUND INC., Park Ridge, IL (US)

(72) Inventors: Stavros Basseas, Park Ridge, IL (US); James Robert Anderson, Chicago, IL (US); Michael John Kilhefner, McHenry, IL (US)

(73) Assignee: CONVERSION SOUND INC., Park Ridge, IL (US)

( * ) Notice: Subject to any disclaimer, the term of this patent is extended or adjusted under 35 U.S.C. 154(b) by 91 days.

(21) Appl. No.: 15/064,922

(22) Filed: Mar. 9, 2016

(65) Prior Publication Data

US 2016/0269817 A1 Sep. 15, 2016

Related U.S. Application Data

(60) Provisional application No. 62/130,190, filed on Mar. 9, 2015.

(51) Int. Cl.

| | |
|---|---|
| ***H04R 1/10*** | (2006.01) |
| ***H04R 1/28*** | (2006.01) |
| *H04R 25/00* | (2006.01) |

(52) U.S. Cl.

CPC ..... *H04R 1/1016* (2013.01); *H04R 1/105* (2013.01); *H04R 1/1083* (2013.01); (Continued)

(58) Field of Classification Search

CPC .... H04R 1/1016; H04R 1/105; H04R 1/1075; H04R 1/1058; H04R 1/1066; H04R 25/652; H04R 2225/025; H04R 5/0335; H04R 1/10; H04R 1/2876; H04R 1/1083; H04R 1/1041; H04R 25/608; G10K 2210/1081

See application file for complete search history.

(56) References Cited

U.S. PATENT DOCUMENTS 2,803,308 A * 8/1957 Di Mattia ..... A61B 7/02 181/135
4,222,378 A * 9/1980 Mahoney ..... A61M 16/0488 128/206.24

(Continued)

FOREIGN PATENT DOCUMENTS

WO WO 99/07182 A2 2/1999

OTHER PUBLICATIONS

Extended European search report from corresponding EP patent application 16159360.3, dated Aug. 2, 2016.

(Continued)

*Primary Examiner* — Oyesola C Ojo
(74) *Attorney, Agent, or Firm* — George S. Pavlik; Husch Blackwell LLP

(57) ABSTRACT

An ear tip made partially of a secondary insert, clamp, sleeve band or other memory retaining elastic material that, when integrated with a biocompatible, soft, highly elastic and vibration and sound damping material provides improved containment and isolation of sound pressure within a sound transmission path and provides the necessary retention for this type of acoustically superior material to be retained properly on a sound generating assembly.

20 Claims, 3 Drawing Sheets

(52) U.S. Cl.
CPC ..... *H04R 1/2876* (2013.01); *H04R 1/1041* (2013.01); *H04R 25/60* (2013.01); *H04R 25/652* (2013.01)

(56) References Cited

U.S. PATENT DOCUMENTS 4,870,688 A * 9/1989 Voroba ..... G09B 21/009 381/60
5,288,953 A * 2/1994 Peart ..... H04R 1/1016 181/130
6,129,175 A * 10/2000 Tutor ..... A61F 11/08 128/864
6,425,398 B1 * 7/2002 Hirshfeld ..... A61F 11/08 128/864
6,513,621 B1 * 2/2003 Deslauriers ..... H04R 1/1016 128/865
6,938,622 B2 * 9/2005 Huang ..... A61F 11/12 128/864
8,590,665 B2 * 11/2013 Stiehl ..... B29C 45/0025 181/130
8,657,064 B2 * 2/2014 Staab ..... H04R 25/656 181/130
9,668,043 B2 * 5/2017 Paschel ..... H04R 1/1091
2002/0006209 A1 1/2002 Mahoney et al.
2003/0037989 A1 * 2/2003 Widmer ..... A61B 5/6817 181/130
2003/0081805 A1 * 5/2003 Fushimi ..... H04R 1/1016 381/325
2003/0178247 A1 * 9/2003 Saltykov ..... A61B 5/411 181/135
2006/0014844 A1 * 1/2006 Lim ..... C08J 9/02 521/154
2008/0109087 A1 * 5/2008 Durgin ..... A61F 5/0079 623/23.65
2008/0187161 A1 8/2008 Tiemens et al.
2010/0246879 A1 * 9/2010 Siahaan ..... B29C 43/021 381/380
2010/0294285 A1 * 11/2010 Turdjian ..... A61F 11/08 128/867
2011/0051979 A1 3/2011 Lee et al.
2011/0271965 A1 * 11/2011 Parkins ..... A61F 11/08 128/867
2012/0039500 A1 * 2/2012 Silvestri ..... H04R 1/105 381/380
2013/0180795 A1 7/2013 Bilan
2013/0202141 A1 * 8/2013 Basseas ..... H04R 25/652 381/328
2013/0343594 A1 * 12/2013 Howes ..... H04R 1/1016 381/380
2014/0153761 A1 * 6/2014 Shennib ..... H04R 25/652 381/328
2014/0355809 A1 * 12/2014 Killion ..... H04R 1/1016 381/380
2016/0014498 A1 * 1/2016 Paschel ..... H04R 1/1091 381/380
2016/0212529 A1 * 7/2016 Epping ..... H04R 1/1016

OTHER PUBLICATIONS

Communication pursuant to Article 94(3) EPC, dated Feb. 14, 2018 (4pgs.).

* cited by examiner

COMFORT AND HIGH RETENTION VIBRATION AND SOUND DAMPING EAR TIPS

CROSS REFERENCE TO RELATED APPLICATION

This application claims the benefit of U.S. Provisional Patent Application Ser. No. 62/130,190 filed Mar. 9, 2015, the entirety of which is hereby incorporated by reference as if fully set forth herein.

FIELD

The subject invention pertains generally to ear tips for sound devices and specifically to ear tips using superior acousto-mechanical damping and comfort assisting materials.

BACKGROUND

Soft ear inserts are part of sound devices which are often worn for significant periods of time during the day. Today, these devices include hearing aids, personal sound amplifiers (PSAP's), Bluetooth Headsets and Audio Headsets, to name a few. These soft ear inserts and associated devices are referred to herein as "ear tips." For these products, early technology used soft urethanes and foams which often discolored or quickly dirtied needing frequent replacement and were rigid enough to cause significant ear discomfort over extended periods of daily usage. The industry has since moved to mostly silicone ear tips which provide a softer material for increased comfort and biocompatibility. Silicone ear tips have also the additional advantage of mechanical elasticity memory. That is, they maintain their grasping force once mounted onto the sound port nozzle.

Silicone based ear tips or ear inserts, widely used today, are biocompatible and can be adjusted to the proper level of softness for the desired comfort. Ear tips used by devices without ear level microphones such as headphones, provide comfort and isolation of the ear canal from ambient sounds. Many times the ambient sounds are not sufficiently attenuated inside the ear canal which can be caused by the ambient sound pressure vibrating the ear insert and deforming the surfaces of the ear insert exposed to and in direct response to the air pressure modulation of said ambient sound field. This deformation propagates through the body of the ear insert which in turn causes deformation of the ear insert on its other surfaces which face the occluded ear canal space. This causes a related sound pressure to be developed inside the ear canal cavity. This effect is especially apparent if the insert is made of thin silicone. The action of the surfaces is similar to the walls of a balloon expanding and contracting in response to changes of the air pressure within. This effect represents the conversion of acoustic energy to mechanical vibrational energy and back to acoustic energy. This unintentional and undesired acoustic to mechanical and back to acoustic (acousto-mechanical) sound coupling is referred to herein as the "ballooning effect." In order to increase the acoustic seal and reduce vibration and the "ballooning effect" of the ear insert and thus increase the attenuation of external ambient sound, the ear inserts need to be made of thicker or harder silicone thus compromising comfort.

For devices that provide high amplification and have ear level microphones, the ear insert should also provide sufficient sound seal as to limit "sound leakage" from inside the ear canal cavity to outside where the microphone is in order to avoid well known feedback. A sound containing or transmission body such as an ear tip or ear insert or a sound tube consists of a body made of a deformable solid material and having first surfaces (or first walls) in contact with a first air path which in turn contains an intended sound pressure (said first air path also referred to as a sound containing or sound transmission path). Second surfaces (or second walls) of the sound containing body may be in contact with other air paths or with free air but are distinguished from first surfaces as not being in direct contact with said first air path. "Sound leakage" is not necessarily due to the obvious failure of an incomplete air-tight seal to close off an unintentional air path or leak from the first air path but also through the same non-obvious mechanism referred to above as the "ballooning effect" wherein said intended sound pressure contained within the first air path expands and contracts the first surfaces or first walls and wherein the expansion and contraction of said first walls or first surfaces causes related deformation of second surfaces or walls which then in turn re-radiates an unacceptable portion of the intended sound pressure as a corresponding unintended sound pressure into said other air paths or to free air. Thus the leakage could be in the form of direct sound pressure leakage due to insufficient air-tight seal or in the form of sound pressure generated by the vibration of the soft walls of ear insert due to the "ballooning effect" from sound pressure delivered to the ear canal enclosed by the ear tip.

Newer, highly elastic yet vibration and sound damping materials have now become available which when used to manufacture an ear tip improve comfort during prolonged headset ear tip usage as well as significantly decrease said "ballooning effect" both to and from the human ear canal. These materials do so by converting less of the mechanical energy imparted by the contained acoustic pressure into expansion and contraction of the walls, while more of said mechanical energy is dissipated as heat within the material due to its internal damping characteristics. Note that damping used to ameliorate the "ballooning effect" should in no way be confused with any unrelated damping of the air path used as a sound passage by placing acoustic resistances in the air path. Any further references to sound damping herein specifically refer to internal vibrational damping of the material making up the walls or surfaces of said sound containing or sound transmission body for containing, isolating or delivering a sound pressure rather than damping the air path of a sound transmission body. The drawback to these types of highly elastic and sound vibration damping materials is that they are so soft and elastic that when they are mounted onto a sound port nozzle of an amplification device they do not have robust mechanical retention. These materials have low elasticity memory and when installed onto a device they often stretch, expand, and remain in this steady state expanded condition. In this condition, the materials by themselves do not provide enough residual retention to remain on the nozzle when being removed from the human ear. This inadequate retention results in the ear insert falling off or remaining stuck in a human ear leaving the user to attempt to remove it, or worse, make a trip to an emergency room or doctor to remove the ear tip. These situations range from a major annoyance to the consumer to more dangerous medical outcomes and increased liability for companies selling these devices.

Low retention forces of ear inserts to amplification devices/headsets (usually those lower than 200-300 grams) often have outcomes of an eventual failure of an ear insert to remain mounted onto a headset. Although this retention force number is dependent on many variables including the base materials of the headset and ear tips, ear wax, body oils, cleanliness of the interface, and geometries of the ear tip, the mating portion of the headset and the human ear canal being entered, the fact remains, at these low forces, potential ear tip mechanical retention failures can and do occur. Higher retention forces of ear tips to headsets (usually those over 1000 g) provide a reliable mechanical retention of the ear tip to the headset supporting any combination of variables described above as well as keeping the force low enough for a user to easily assemble an ear tip on their headset.

It is not intended to specifically define herein all current and future materials that fall into the category described as "highly elastic, sound and vibration damping" materials which reduce the "ballooning effect". One such material available today is Qflex made by Flexan Corp. Silicone, by contrast, has far less vibration and sound damping capability.

In view of the foregoing, there is a need for an alternative means for creating mechanical retention to allow technically superior, highly elastic, sound and vibration dampening acoustic ear tip materials to maintain proper retention on associated headset devices.

DETAILED DESCRIPTION

Figure 1A:
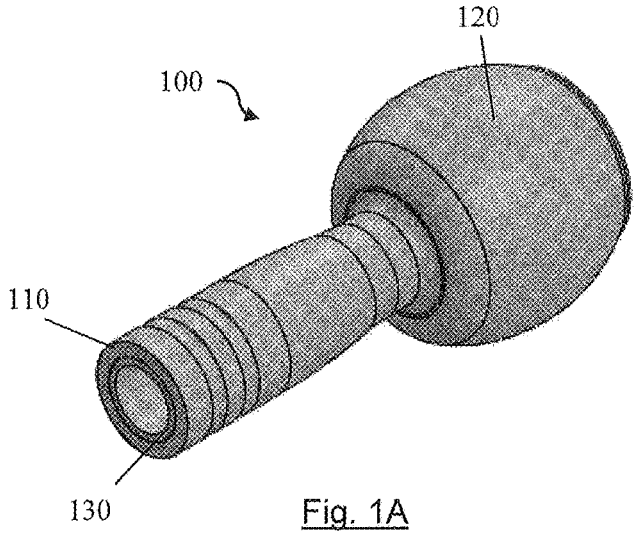
FIG. 1A is a perspective view of an ear tip according to embodiments set forth herein with the ear tip in an inverted state.

While this invention is susceptible of embodiment in many different forms, there are shown in the drawings and will be described herein in detail specific embodiments thereof with the understanding that the present disclosure is to be considered as an exemplification of the principles of the invention and is not intended to limit the invention to the specific embodiments illustrated.

As presented herein, embodiments of the subject invention are directed to an ear tip having at least one section made of a soft, vibration and sound damping material and at least one section made of a memory retaining, higher retention force material. In use, the memory retaining, higher retention force material can be provided as an insert to the soft, vibration and sound damping material section, or can be provided on the outside of the soft, vibration and sound damping material section.

A suitable high retention force material can be chemically or mechanically integrated to the ear tip to allow for improved retention to a sound generating device. For example, a memory retaining elastic material, like silicone or urethane, may be chemically/mechanically added to the molding of the highly elastic, vibration and sound damping material through any number of processes (compression molding, transfer molding, injection molding, bonding, etc.) which would allow the retention feature of the ear tip to provide increased retention to the ear tip while the headset-human interface of the ear tip retains its superior acoustic, comfort, and vibration and sound damping properties.

In accordance with one embodiment of the present invention, one or more segments of the ear tip are made of the described soft, vibration and sound damping material and another segment is an insert of memory retaining, higher retention force material which provides reliable retention force during use and prevents the ear tip from becoming lodged in the user's ear or falling off the headset device during removal from the ear.

In accordance with another embodiment of the present invention, the memory retaining, higher retention force material is provided on the outer diameter (OD) of the ear tip construction which would provide a similar force on the headset and maintain the retention needed during usage.

In accordance with yet another embodiment of the present invention, memory retaining, higher retention force elastic materials in the form of non-bonded sleeves, clamps or bands can be assembled to the soft, vibration and sound damping material that provide reliable retention force during use, thereby preventing the ear tip from becoming lodged in the users' ear or falling off the headset device during removal from the ear.

Figure 1B:
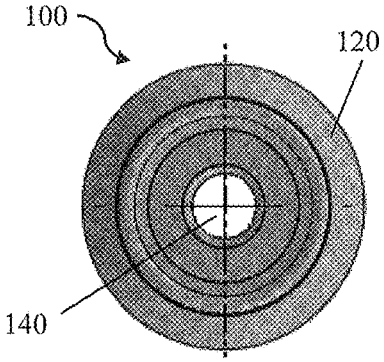
FIG. 1B is a front elevation view of the ear tip represented in FIG. 1A.
Figure 1C:
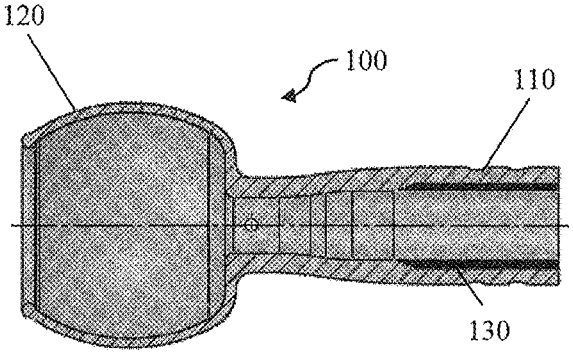
FIG. 1C is a cross-sectional side view of the ear tip represented in FIG. 1A.

With reference now to the figures, FIGS. 1A, 1B, and 1C illustrate a three dimensional representation of an ear tip 100 with the ear tip 100 in an inverted state. As shown, Ear tip 100 can have ear tip segments 110 and 120 made of a soft, vibration and sound damping material. Ear tip segments 110 and 120 can be integrally joined. Ear tip segment 110 can be an elongated, hollow tube and can taper toward its end where it joins ear tip segment 120. Ear tip segment 120 can be designed to fit comfortably in a user's ear canal, thereby holding the ear tip in place during use. Ear tip segment 120 can be an ear dome. Such ear domes are shaped and fitted to fit securely within the concha portion and outer canal portion of a wearer's ear. FIGS. 1A, 1B, and 1C illustrate such an ear dome with the elastic of the dome inverted from its normal operating state. Ear tip 100 can have retaining segment 130 of memory retaining, higher retention force material. Retaining segment 130 take the form of a hollow, cylindrical insert which can be placed inside the internal diameter of ear tip segment 110 in order to attach the ear tip 100 to a sound nozzle. Ear tip segment 100 can provide a sound path 140 for sound traveling from a sound device to a user's ear canal. Sound path 140 can be a central channel passing through ear tip segments 110 and 120 and retaining segment 130.

Figure 2A:
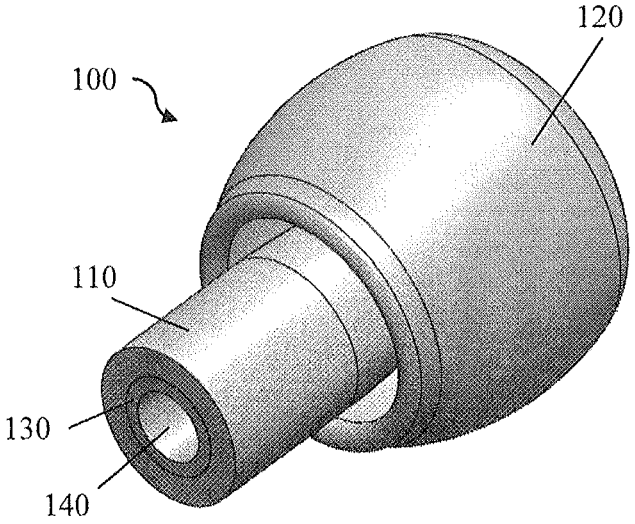
FIG. 2A is a perspective view of an ear tip according to embodiments set forth herein with the ear tip in its non-inverted, normal state.
Figure 2B:
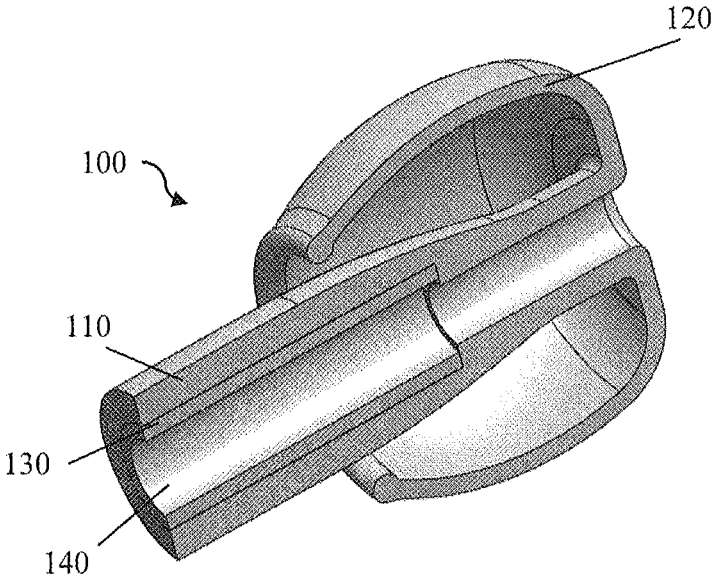
FIG. 2B is a cross-sectional side view of the ear tip represented in FIG. 2A.

FIGS. 2A and 2B illustrate a three dimensional representation of ear tip 100 with the ear tip 100 in its normal, non-inverted state. FIGS. 2*a* and 2B illustrate ear segment 120 in the form of an ear dome with the elastic of the dome in its normal operating state.

Figure 3A:
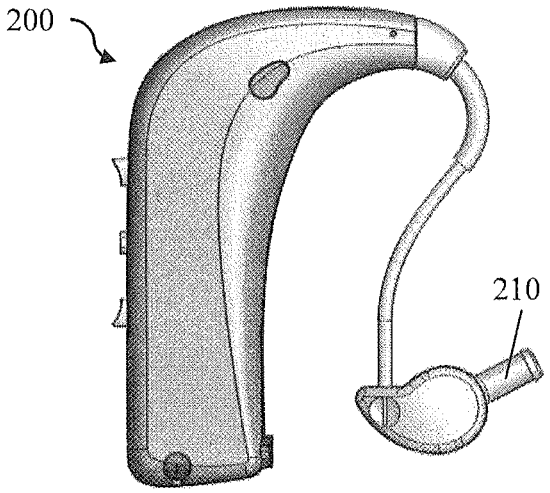
FIG. 3A is a side elevation view of a sound generating device having a sound nozzle for attachment to an ear tip according to embodiments set forth herein.

FIG. 3A illustrates a representative sound generating device 200 having a sound nozzle 210 for attachment to an ear tip according to embodiments presented herein.

Figure 3B:
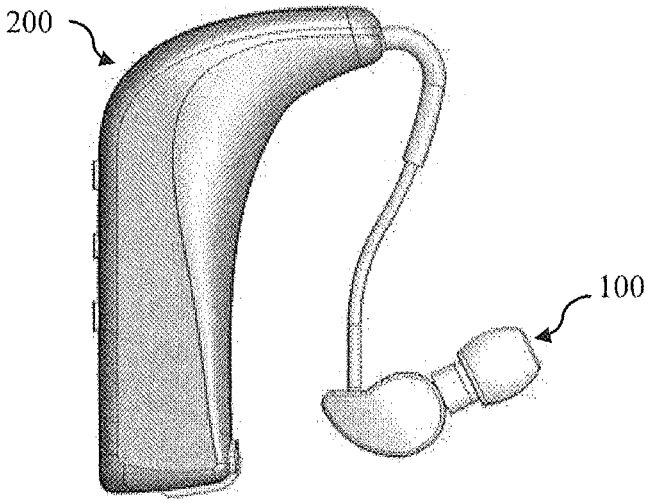
FIG. 3B is a side elevation view of the sound generating device represented in FIG. 3A with an ear tip according to embodiments set forth herein attached to the sound nozzle.

FIG. 3B shows the sound generating device 200 with the ear tip 100, as shown in FIG. 2, attached. The memory retaining, higher force material insert segment of ear tip 100 can mount the ear tip 100 to the sound nozzle 210 of sound generating device 200.

The insert as described in FIGS. 1 and 2 can be comprised of memory retaining material fabricated by any means (most usually some form of molding) and may be an independent item prior to fabrication of the ear tip itself. Once fabricated, this insert can be installed into an ear tip tool (either manually or through automated processes) and "over molded" onto the ear tip thus resulting in a single part with two dis-similar materials. Alternatives to this process could include, but are not limited to, bonding of an independent insert to the ear tip, or co-injection molding the insert in a tool first, the insert becoming an independent part for a very short period of time, and then finishing the part with the highly elastic material in a secondary molding process.

Although the examples shown in FIGS. 1-3 depict a typical "barbed nozzle" feature which is commonly used in headset applications, this invention is not limited to that specific geometry. For example, there are many headset geometries and ear tip geometries, with some ear tips or "boots" encompassing nearly the entire headset with the soft, vibration and sound damping elastic material. Embodiments disclosed herein can encompass such non-traditional geometries and includes any application using the described soft, high vibration and sound damping elastic materials along with memory retaining, higher retention force materials for retention on a headset body. Such applications may include the predefined chemical/mechanical bonding and molding to ear tips, or non-bonded sleeves, clamps or bands to secure the soft, high vibration and sound damping material to the headset. Such embodiments can provide a reliable enough retention force during use to prevent the ear tip from becoming lodged in the users ear or falling off the headset device during removal from the ear.

From the foregoing, it will be observed that numerous variations and modifications may be effected without departing from the spirit and scope hereof. It is to be understood that no limitation with respect to the specific apparatus illustrated herein is intended or should be inferred. It is, of course, intended to cover by the appended claims all such modifications as fall within the scope of the claims.

What is claimed is:

1. A sound transmission apparatus comprising:

an ear tip comprising a sound transmission path, a first section comprising a first elastic material, and a second section comprising a second elastic material different from the first elastic material, the second section being fixedly bonded to the first section to form a single integrally-formed piece;

wherein the first elastic material is a flexible, biocompatible material exhibiting greater vibration and sound dampening properties than the second elastic material, wherein the second elastic material has memory retaining properties having a higher memory retention than the first elastic material, and wherein the second section comprises an insert contained entirely within the first section, the insert having an open end and a hollow interior channel extending from the open end to an opposing end seated against the first section, the open end of the insert being elastically securable to a nozzle of a sound generating device external and removably securable to the sound transmission apparatus.

2. A sound transmission apparatus as in claim 1 wherein sound pressure is delivered to a user's ear canal through the sound transmission path, said sound transmission path comprising surfaces of at least said first material and an air path;

wherein, in response to sound pressure contained within said air path of said sound transmission path, expansion and contraction of the surfaces of said sound transmission path being reduced by vibration and sound dampening properties of said first elastic material.

3. A sound transmission apparatus as in claim 1 further comprising:

the sound generating device;

wherein at least the second elastic material provides a retention force which couples the ear tip to the sound generating device.

4. A sound transmission apparatus as in claim 1 wherein the sound generating device is positionable behind an ear of a user and the ear tip is positionable at least partially within an ear canal of the user.

5. A sound transmission apparatus as in claim 1 wherein the sound transmission path is at least partially defined by the second section, the hollow interior channel of the insert being defined by an interior wall, the interior wall of the insert being straight along the entire length of the insert from the open end to the opposing end.

6. A sound transmission apparatus as in claim 5 wherein the sound transmission path is at least partially defined by the first section.

7. A sound transmission apparatus as in claim 1 wherein the ear tip further comprises a third section made of the first elastic material and the third section is formed to fit the ear of a user.

8. A sound transmission apparatus as in claim 7 wherein the first section comprises an elongated stem portion extending from the open end of the insert to the third section, the third section comprising an ear dome at a tip of the first section opposite the open end of the insert, wherein when the sound transmission apparatus is in a condition of use, the ear dome integrally extends radially outward from an opening in the tip of the first section and curves away from the tip of the first section to cover at least a portion of the stem, a space being defined between an exterior of the stem and an underside of the dome.

9. A method of securing an ear tip to a sound generating device comprising:

providing a sound generating device;

providing an ear tip comprising a sound transmission path, a first section comprising a first elastic material, and a second section comprising a second elastic material different from the first elastic material, the second section being fixedly bonded to the first section to form a single integrally-formed piece;

wherein the first elastic material is a flexible biocompatible material exhibiting greater vibration and sound dampening properties than the second elastic material, wherein the second elastic material has memory retaining properties having a higher memory retention than the first elastic material, wherein at least the second elastic material provides a retention force which secures the ear tip to the sound generating device, and wherein the second section comprises an insert contained entirely within the first section, the insert having an open end and a hollow interior channel extending from the open end to an opposing end seated against the first section, elastically securing the open end of the insert to a nozzle of a sound generating device external and removably securable to the sound transmission apparatus.

10. A method as in claim 9 further comprising placing the sound generating device behind an ear of a user and positioning the ear tip at least partially within an ear canal of the user.

11. A method as in claim 9 wherein the sound transmission path is at least partially defined by the second section.

12. A method as in claim 11 wherein the sound transmission path is at least partially defined by the first section, the hollow interior channel of the insert being defined by an interior wall, the interior wall of the insert being straight along the entire length of the insert from the open end to the opposing end.

13. A method as in claim 9 wherein the ear tip further comprises a third section made of the first elastic material and the third section is formed to fit the ear of a user.

14. A method as in claim 13 wherein the first section comprises an elongated stem portion extending from the open end of the insert to the third section, the third section comprising an ear dome at a tip of the first section opposite the open end of the insert, wherein when the sound transmission apparatus is in a condition of use, the ear dome integrally extends radially outward from an opening in the tip of the first section and curves away from the tip of the first section to cover at least a portion of the stem, a space being defined between an exterior of the stem and an underside of the dome.

15. A sound transmission apparatus comprising:

an ear tip comprising a sound transmission path, a first section comprising a first elastic material, and a second section comprising a second elastic material different from the first elastic material, the second section being fixedly bonded to the first section to form a single integrally-formed piece;

wherein the first elastic material is a flexible, biocompatible material exhibiting greater vibration and sound dampening properties than the second elastic material, wherein the second elastic material has memory retaining properties having a higher memory retention than the first elastic material, and wherein the first section comprises a stem portion extending from an open end to a ear dome opposite the open end, a central channel extending through the interior of the stem from the open end to the ear dome, the second elastic material providing retention force for enabling the open end to be elastically securable to a nozzle of a behind the ear sound generating device, the sound generating device being external and removably securable to the sound transmission apparatus.

16. A sound transmission apparatus as in claim 15 wherein sound pressure is delivered to a user's ear canal through the sound transmission path, said sound transmission path comprising surfaces of at least said first material and an air path;

wherein, in response to sound pressure contained within said air path of said sound transmission path, expansion and contraction of the surfaces of said sound transmission path being reduced by vibration and sound dampening properties of said first elastic material.

17. A sound transmission apparatus as in claim 15 further comprising:

the sound generating device.

18. A sound transmission apparatus as in claim 15 wherein the sound transmission path is at least partially defined by the second section.

19. A sound transmission apparatus as in claim 18 wherein the sound transmission path is at least partially defined by the first section.

20. A sound transmission apparatus as in claim 15 wherein the ear dome is at a tip of the first section opposite the open end of the stem portion, wherein when the sound transmission apparatus is in a condition of use, the ear dome integrally extends radially outward from an opening in the tip of the first section and curves away from the tip of the first section to cover at least a portion of the stem, a space being defined between an exterior of the stem and an underside of the dome.

* * * * *